US006539745B1

(12) United States Patent
Harmer et al.

(10) Patent No.: US 6,539,745 B1
(45) Date of Patent: Apr. 1, 2003

(54) RECEPTACLE FOR VESSEL AND METHOD OF FORMING SAME

(75) Inventors: Charles G. Harmer, Fredericktown, OH (US); Richard C. Poth, Mansfield, OH (US)

(73) Assignee: Designed Metal Products, Inc., Mansfield, OH (US)

( * ) Notice: Subject to any disclaimer, the term of this patent is extended or adjusted under 35 U.S.C. 154(b) by 0 days.

(21) Appl. No.: 10/216,969

(22) Filed: Aug. 12, 2002

Related U.S. Application Data

(62) Division of application No. 09/840,540, filed on Apr. 23, 2001, now Pat. No. 6,453,697.

(51) Int. Cl.[7] ..... F25B 43/00

(52) U.S. Cl. ..... 62/503; 29/509; 220/601

(58) Field of Search ..... 62/503, 509, 474; 220/601; 29/509, 773, 446

(56) References Cited

U.S. PATENT DOCUMENTS

| | | | | |
|---|---|---|---|---|
| RE6,392 | E | | 4/1875 | Scaife |
| 207,007 | A | | 8/1878 | Brooks |
| 262,143 | A | | 8/1882 | Stevenson |
| 3,558,362 | A | | 1/1971 | McHenry |
| 3,942,332 | A | | 3/1976 | Schumacher |
| 4,231,230 | A | | 11/1980 | Gratzer et al. |
| 4,231,488 | A | * | 11/1980 | Ward et al. ..... 220/288 |
| 4,341,321 | A | | 7/1982 | Gombas |
| 4,354,362 | A | | 10/1982 | Schumacher et al. |
| 4,835,986 | A | | 6/1989 | Carlisle, Jr. |
| 4,920,766 | A | | 5/1990 | Yamamoto et al. |
| 4,938,037 | A | | 7/1990 | Carlisle, Jr. |
| 4,939,904 | A | | 7/1990 | Carlisle, Jr. |
| 5,048,309 | A | | 9/1991 | Carlisle, Jr. |
| 5,191,775 | A | | 3/1993 | Shiina et al. |
| 5,217,138 | A | * | 6/1993 | Nichols ..... 220/495.06 |
| 5,285,923 | A | * | 2/1994 | Brandon, Jr. ..... 220/601 |
| 5,507,159 | A | | 4/1996 | Cooksey |
| 5,651,266 | A | | 7/1997 | Hutchison et al. |
| 5,685,331 | A | | 11/1997 | Westermeyer |
| 5,746,065 | A | | 5/1998 | Patel et al. |
| 5,774,982 | A | | 7/1998 | Hutchison et al. |
| 5,850,743 | A | | 12/1998 | Dreiman et al. |
| 5,979,694 | A | | 11/1999 | Bennett et al. |
| 6,062,039 | A | | 5/2000 | Haramoto et al. |
| 6,092,284 | A | | 7/2000 | Dreiman et al. |
| 6,129,522 | A | | 10/2000 | Seo |
| 6,131,405 | A | | 10/2000 | Griffin et al. |

* cited by examiner

*Primary Examiner*—William C. Doerrler
*Assistant Examiner*—Mohammad M. Ali
(74) *Attorney, Agent, or Firm*—Renner, Otto, Boisselle & Sklar, LLP

(57) ABSTRACT

A vessel for use in a refrigeration system. The vessel includes a vessel body and at least one end wall for closing the vessel body, the end wall having a threaded receptacle. The threaded receptacle is configured to accept a threaded fitting and the threaded receptacle includes: an annular sealing surface for engaging a corresponding surface of the fitting, the sealing surface formed on a first side of the end wall; and a threaded surface defined by an inside wall of an annular protrusion, the annular protrusion having a longitudinal axis disposed generally perpendicular to the sealing surface, and wherein the protrusion extends longitudinally from a second side of the end wall toward an interior of the vessel body.

11 Claims, 4 Drawing Sheets

RECEPTACLE FOR VESSEL AND METHOD OF FORMING SAME

RELATED APPLICATION DATA

This application is a divisional of U.S. patent application Ser. No. 09/840,540, filed Apr. 23, 2001, now U.S. Pat. No. 6,453,697 the disclosure of which is herein incorporated by reference in its entirety.

FIELD OF THE INVENTION

The present invention relates generally a receptacle and, more particularly, to a receptacle for use in conjunction with a device such as a vessel. The vessel can be incorporated, for example, into a refrigeration system.

BACKGROUND OF THE INVENTION

A refrigeration system comprises a compressor which conveys compressed refrigerant in a gas state to a condenser where it is cooled into a liquid state and passed to an evaporator. In the evaporator, the now-liquid refrigerant evaporates into a gas thereby absorbing heat energy and cooling an associated area. Thereafter, the now-gas refrigerant flows back to the compressor to repeat the cycle. A regulator supplies oil to the crankcase of the compressor to lubricate its moving parts and to enhance sealing of its piston for efficient compressing. An accumulator/separator can be provided to separate the oil (which becomes atomized and mixed with the refrigerant in the compressor) from the vapor so that only refrigerant is conveyed to the condenser input. A muffler can also be provided either upstream or downstream of the compressor to reduce noise levels.

A regulator, an accumulator, and a muffler each typically comprise a vessel having inlet/outlet fittings for connection to the appropriate system line. For example, the regulator can have an inlet fitting in it top end wall for connection to a supply line of an oil reservoir. The accumulator can have an inlet fitting in its top end wall for connection to the compressor discharge line, an outlet fitting in its top end wall for connection to the condenser input line, and an outlet fitting in its bottom end wall for connection to a drain line to the oil reservoir. If the muffler is a suction muffler (i.e., upstream of the compressor), it can have an inlet fitting on its top wall for connection to the evaporator output line and an outlet fitting on its top wall for connection to the compressor suction line. If the muffler is a discharge muffler (i.e., downstream of the compressor), it can have an inlet fitting in its top wall for connection to the compressor discharge line and an outlet fitting in its bottom wall for connection to the condenser input line. In any event, the interface of the inlet/outlet fittings in the top or bottom walls create joints in the vessel's construction.

Regulators, accumulators, and mufflers are typically mounted on or near the compressor whereby compressor-generated vibration is transmitted thereto. This vibration can stress any susceptible joints in the vessel construction and the stress level can be sufficient to fatigue and damage the individual components.

In some applications, it may be desirable to attach a device such as a pressure relief valve or a refrigerant line onto the vessel using a threaded fitting. Accordingly, the vessel can be provided with a compatible inlet fitting to receive the device. The inlet fitting should have a sealing surface and a threaded protrusion to mate with the device. However, known techniques for forming such an inlet fitting have proved to be problematic.

One technique for forming the fitting includes extruding a metal blank to form the inlet fitting. The process of extrusion typically includes piercing a hole in the blank and then flanging the metal surrounding the hole to produce a protrusion of metal which extends longitudinally from the parent metal of the blank. The length of the protrusion is limited by the strain capacity of the metal, which, if exceeded, will cause the edge of the protrusion to fracture or split. In addition, extrusion of the metal thins the thickness of the protrusion wall, especially at the end of the protrusion and where the protrusion meets the parent metal. Therefore, the resultant protrusion will have a tapered wall thickness and will have a relatively large radius where the protrusion meets the parent metal. These characteristics are not well suited to receiving a threaded fitting.

According, there is a need in the art for a vessel having an inlet fitting adapted to receive a threaded device, such as a pressure relief valve or a refrigerant line. There is also a need in the art for techniques for forming such an inlet fitting.

SUMMARY OF THE INVENTION

According to one aspect of the invention, the invention is directed to a vessel for use in a refrigeration system. The vessel includes a vessel body and at least one end wall for closing the vessel body, the end wall having a threaded receptacle. The threaded receptacle is configured to accept a threaded fitting and the threaded receptacle includes: an annular sealing surface for engaging a corresponding surface of the fitting, the sealing surface formed on a first side of the end wall; and a threaded surface defined by an inside wall of an annular protrusion, the annular protrusion having a longitudinal axis disposed generally perpendicular to the sealing surface, and wherein the protrusion extends longitudinally from a second side of the end wall toward an interior of the vessel body.

According to another aspect of the invention, the invention is directed to a method of making a threaded receptacle. The method includes drawing a metal blank with a drawing punch to form an intermediate protrusion and thereby gathering metal for the sealing surface and annular protrusion; forming a hole in a bottom of the drawn intermediate protrusion; capturing the metal blank in a capture die having a first portion with a stop surface against which the sealing surface is formed and a second portion defining an opening for controlling formation of an outside diameter of the annular protrusion; and reflowing the drawn intermediate protrusion with a punch, the punch having a pilot for controlling the formation of an inside diameter of the annular protrusion and an engagement surface for engaging a distal edge of the intermediate protrusion.

These and other features of the invention are fully described herein and particularly pointed out in the claims. The following description and drawings set forth in detail a certain illustrative embodiment of the invention, this embodiment being indicative of but one of the various ways in which the principles of the invention may be employed.

DRAWINGS

DETAILED DESCRIPTION

Figure 1:
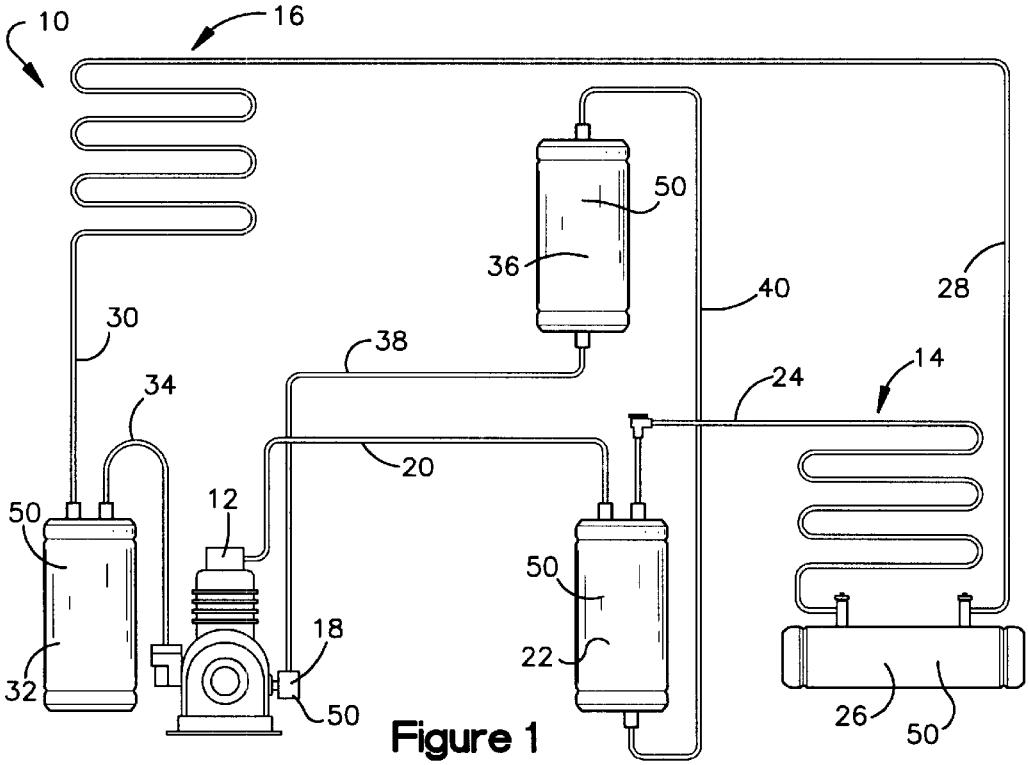
FIG. 1 is a schematic diagram of a refrigeration system including an oil regulator, an accumulator and a muffler that can each incorporate a vessel according to the present invention.

In the detailed description which follows, identical components have been given the same reference numerals, regardless of whether they are shown in different embodiments of the present invention. To illustrate the present invention in a clear and concise manner, the drawings may not necessarily be to scale and certain features may be shown in somewhat schematic form.

Referring now to the drawings, and initially to FIG. 1, a refrigeration system 10 is schematically shown which comprises a compressor 12, a condenser 14, and an evaporator 16. The compressor 12 conveys compressed gas refrigerant to the condenser 14 whereat it is cooled into a liquid state and conveyed to the evaporator 16. In the evaporator 16, the now-liquid refrigerant evaporates into a gas thereby absorbing heat energy and cooling an associated area. Thereafter, the now-gas refrigerant flows back to the compressor 12 to repeat the cycle. A regulator 18 supplies oil to the crankcase of the compressor 12 to lubricate its moving parts and to enhance sealing of its piston for efficient compressing.

More specifically, the refrigerant passes from the compressor discharge line 20 to an accumulator/separator 22 where oil (which becomes atomized and mixed with the refrigerant) is separated from the vapor so that only refrigerant is conveyed through the condenser input line 24. In the condenser 14, the condensed liquid is captured in a receiver 26 and then is conveyed through the condenser output line 28 to the evaporator 16. The evaporated refrigerant passes from the evaporator output line 30 to a muffler 32 and then to the compressor suction line 34. Oil from a reservoir 36 is provided to the regulator 18 through a supply line 38 and oil is returned to the reservoir 36 from the accumulator 22 by a drain line 40.

The regulator 18, the accumulator 22, the receiver 26 and/or the muffler 32 each comprise a vessel 50 containing the relevant control devices and inlet/outlet fittings for connection of these devices to the appropriate lines in the system 10. In the illustrated system 10, the regulator 18 is mounted on the compressor 12, the accumulator 22 is mounted in series with the compressor discharge line 20, the receiver 26 is mounted in series with the condenser 14 and the muffler 32 is mounted in series with the compressor suction line 34. The mounting of these and other components (e.g., a discharge muffler or separator) on, near, or in series with the compressor(s) is fairly typical of most refrigerant systems. Accordingly, the compressor-generated vibration is transmitted to these components. In addition, the refrigerant may be under pressure as it cycles through the refrigeration system 10. Furthermore, for desired refrigeration system 10 operation, the inside cubic volume of the respective vessels 50 should be manufactured within specified parameters.

Figure 2:
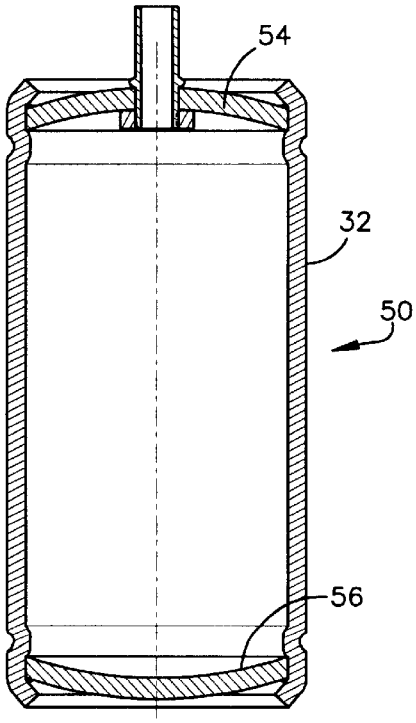
FIG. 2 is an isolated longitudinal cross-sectional view of the vessel.

Referring now to FIG. 2, the vessel 50 according to the present invention is shown isolated from the rest of the refrigeration component. The vessel 50 can be used with the regulator 18, the accumulator 22, the receiver 26, the muffler 32, and/or any other refrigerant system components. That being said, the vessel 50 can be used with non-refrigeration components where factors such as pressure tolerance, vibration tolerance and/or volume control are a concern or, for that matter, even where any or all of these factors are not an issue.

The vessel 50 comprises a cylindrical wall 52 and end walls 54 and 56. In the illustrated embodiment, the cylindrical wall 52 has a generally tubular shape with a substantially constant circular cross-section and the end walls 54/56 are each domed circular plates. The walls 52, 54 and 56 can be of single or multi-piece constructions, can be continuous or non-continuous, and can be made of any suitable material, such as metal (e.g., steel, copper, aluminum, etc.). While a variety of wall shapes are possible (each of which falling within the scope of the invention), it is noted that one advantage of circular shapes is simplification of the fabrication process. Therefore, the term cylindrical wall 52 is intended to include any elongated hollow member having a cross-section of any shape, such shape may change in size or configuration along the length of the cylindrical wall 52. The end walls 54/56 will have a corresponding size and shape. The term diameter is meant to include the distance from one point to another point along a straight line passing though the center of the vessel in a cross-sectional plane, regardless of the shape of the cylindrical wall 52 or end wall 54/56. Although the end walls 54/56 are illustrated as being domed (for reasons discussed below), it is understood that the end walls 54/56 can be made of flat plates or plates which are curved toward the inside of the vessel 50.

Figure 3:
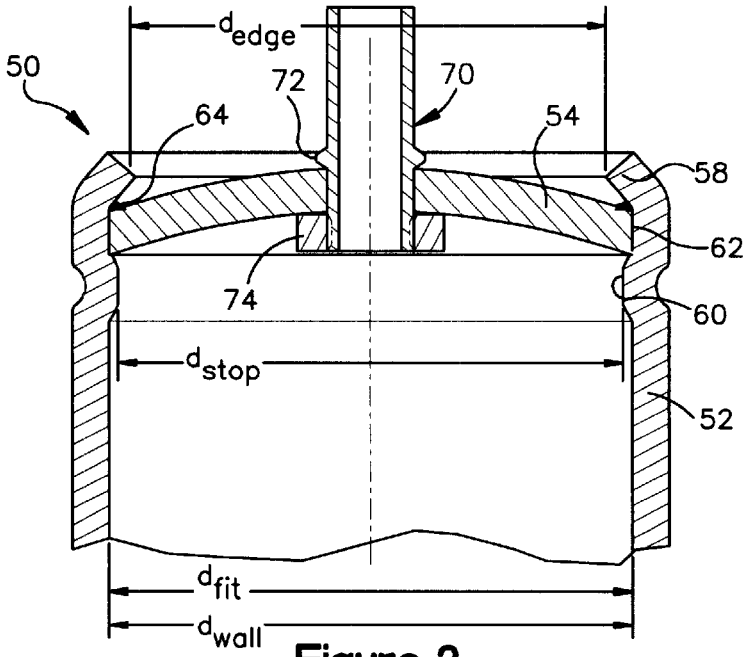
FIG. 3 is an enlarged cross-sectional view of upper portions of the vessel.

Referring now to FIG. 3, upper portions of the vessel 50 are illustrated in more detail. As shown, the cylindrical wall 52 has an edge portion 58, a radially inward shoulder portion 60, and a capture portion 62 therebetween. The edge portion 58 is turned (e.g., rolled, crimped or pressed) radially inward to a diameter $d_{edge}$ less than the outer diameter $d_{wall}$ of the end wall 54. The shoulder portion 60 has an inner diameter $d_{stop}$ less than the diameter $d_{wall}$ of the end wall 54. The capture portion 62 has an inner diameter $d_{fit}$ slightly greater than the diameter $d_{wall}$ of the end wall 54.

The end wall 54 is interference fit within the capture portion 62 with the shoulder portion 60 forming a positive stop therefore. In certain situations, such as refrigeration systems, the end wall 54 can be welded, brazed, soldered, or otherwise secured to the cylindrical wall 52 to form a leak-proof seam 64 and/or improve other mechanical properties if the vessel 50. However, the vessel 50 can certainly be made and used without such a seam between the walls, if desired.

As indicated above, the end wall 54 is preformed to be curved, or domed, outward. In one embodiment, the end wall 54 is bowed outward a distance which is about the same as the thickness of the material used for the end wall 54. For example, if the end wall 54 is 0.075 inches thick, the center of the end wall 54 will be axially displaced approximately 0.075 inches from an edge of the end wall 54. The domed arrangement of the end wall 54 helps to control final positioning of the end wall 54. More specifically, during turning of the edge portion 58 (e.g., by rolling, crimping or pressing) an otherwise flat end wall 54 can tend to shift out of position if the end wall 54 "oilcans", or buckles inward. The presence of the preform minimizes inward buckling which could otherwise cause the end wall 54 to shift. Any tendency of the end wall 54 to deform outward during the edge portion 58 turning may be controlled by temporarily placing a stop adjacent the end wall 54 to maintain the end wall 54 placement during edge portion 58 turning. As a result of the preform, the integrity of the closure formed by the end wall 54 and the cylindrical wall 52 is enhanced.

The bottom end wall 56 can be attached to the cylindrical wall 52 in the same interference-fit manner or can be attached thereto in another manner (e.g., formed integrally therewith). Alternatively, the top end wall 54 could be attached to the cylindrical wall 52 in another manner. Any construction wherein at least one of the end walls 54 and 56 are attached to the cylindrical wall 52 in the interference-fit manner is possible with, and contemplated by, the present invention.

The end wall 54 is shown with an inlet/outlet fitting 70 extending through an appropriately-sized opening therein and secured thereto by, for example, a lip 72 and a weld 74. One or more such fittings will be common in the refrigeration components discussed above. For example, in the illustrated system 10 (FIG. 1), the regulator 18 has an inlet fitting in its top end wall for connection to the oil supply line 38. The accumulator 22 has an inlet fitting in its top end wall for connection to the compressor discharge line 20, an outlet fitting in its top end wall for connection to the condenser input line 24, and an outlet fitting in its bottom end wall for connection to the oil drain line 40. The muffler 32 (which is a suction muffler) has an inlet fitting on its top wall for connection to the evaporator output line 30 and an outlet fitting on its top wall for connection to the compressor suction line 34. In any event, the attachment of these inlet/outlet fittings essentially create joints which can be susceptible to breakage due to compressor-generated vibration.

With the present invention, the stress conventionally concentrated near the inlet/out joints in the end walls 54/56 has been found to be distributed through the shoulder portion 60 to the cylindrical wall 52. While not wishing to be bound by theory, it is believed that stop formed by the shoulder portion 60 allows a slight of flexing in the cylindrical wall 52 thereby relieving the inlet/outlet joints on the end wall 54/56 from the brunt of the stress. If the vessel 50 is to be used in a high vibration setting and requires a leak-proof seal between the walls, further stress distribution advantages can be gained if the seam 64 is formed by brazing with a more plastic-like metal, such as copper.

Figure 4A:
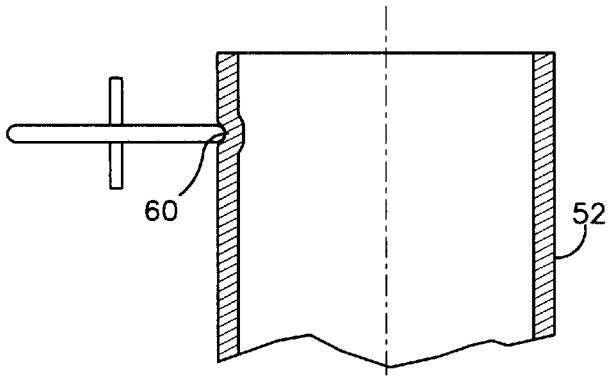
FIGS. 4A–4D are schematic views of a method of making the vessel according to the present invention.

Referring now to FIGS. 4A–4D, a method of making the vessel 50 according to the present invention is shown. Initially, the shoulder portion 60 can be formed in the cylindrical wall 52 by a simple crimping step as is known in the art. (FIG. 4A.) For example, the shoulder portion 60 can be formed by rolling the cylindrical wall against a roller as illustrated. As one skilled in the art will appreciate, the shoulder portion 60 can be formed by any machining process (for example, by pressing, crimping, rolling, etc.), each of which are intended to fall within the scope of the invention.

Figure 4B:
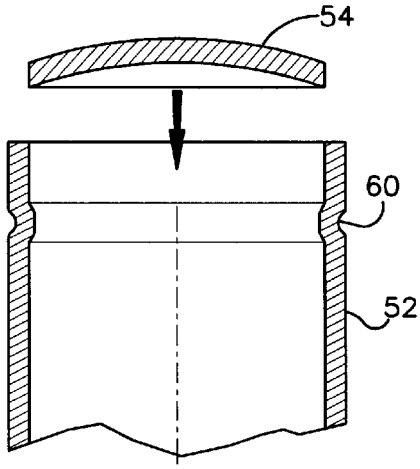
Figure 4C:
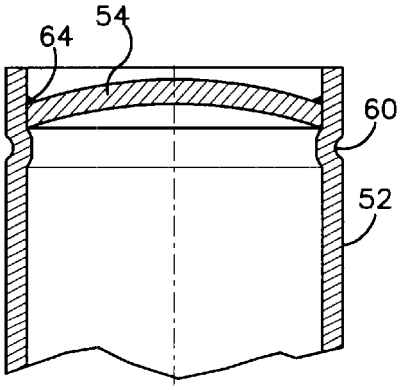

The end wall 54 can then be placed on the stop formed by the shoulder portion 60. (FIG. 4B.) Optionally, the seam 64 can be formed between the outer diameter of the end wall 54 and the cylindrical wall 52, such as by brazing, welding or soldering. (FIG. 4C.) The seam can be formed above the end wall as illustrated and/or under the end wall 54 from the interior of the cylindrical wall. It is noted that the stop not only assists in holding the end wall 54 in place during seam 64 formation by acting as a seating surface, the stop also acts as a slag shield to minimize or prevent debris from entering the interior of the vessel being formed.

Figure 4D:
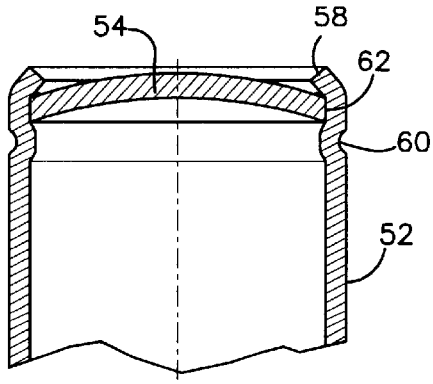

Thereafter, the edge portion 58 is turned over the radially outer edge of the end wall 54 by an uncomplicated pressing step. (FIG. 4D.) As one skilled in the art will appreciate, the edge portion 58 can be turned by any machining process (for example, by pressing, crimping, rolling, etc.), each of which are intended to fall within the scope of the invention.

Accordingly, not only can the vessel 50 be made with geometrically uncomplicated wall shapes, it can also be made in a relatively easy manufacturing process. Additionally, the process by which the vessel is made can be controlled to regulate features of the vessel 50, such as internal cubic volume and amount of contact between the end wall 54 and cylindrical wall 52 (e.g., between the end wall 54 and the stop, between the end wall 54 and the capture portion 62 and/or between the end wall 54 and the edge portion 58). As one skilled in the art will appreciate, the vessel 50 can be formed to have good integrity when subjected to positive or negative pressures inside the vessel 50 relative to an environment outside the vessel 50, thereby reducing the likelihood that the vessel 50 will leak or rupture. Additionally, the present invention provides a vessel 50 and an economical method of making the same which allows the walls to have a simple shapes and reduce the concentration of vibration-induced stress at inlet/outlet interfaces on the end walls 54 and 56.

Figure 5A:
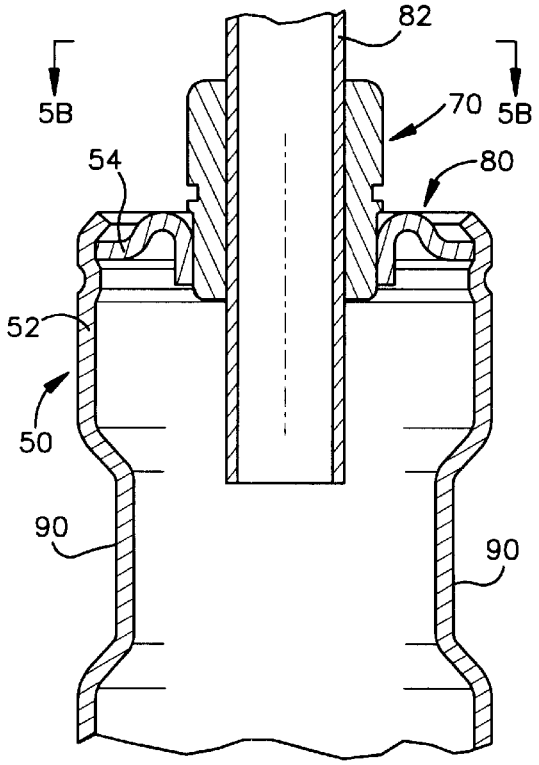
FIG. 5A is a cross-sectional view of upper portions of the vessel in an embodiment where the vessel has an end wall with a concentric rib.
Figure 5B:
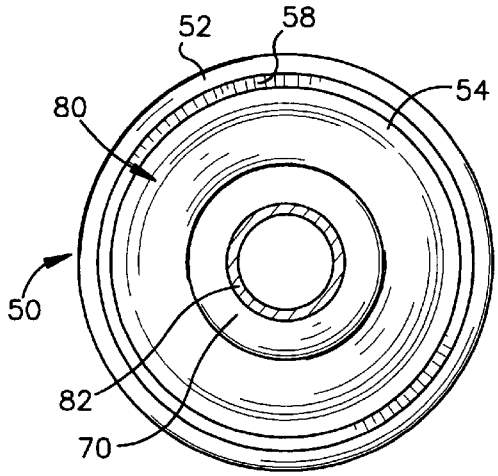
FIG. 5B is an end view of the vessel illustrated in FIG. 5A.

Referring now to FIGS. 5A and 5B, a portion of the vessel 50 with an end wall 54 having a concentric raised rib 80 is illustrated. While not wishing to be bound by theory, it is believed that the concentric rib 50 adds strength to the end wall 54 and distributes stress and vibrations, thereby relieving the inlet/outlet joint 70 from stresses cause by vibration or movement transmitted through the assembly in which the vessel 50 is disposed. Example vibrations which may place stress on the inlet/outlet fitting 70 include vibrations from a compressor that are transmitted along a refrigerant tube 82 to the vessel 50 and vibrations transmitted to the vessel 50 by a bracket used to support the vessel 50.

As illustrated, the end wall 54 is secured to the cylindrical wall 52 of the vessel 50 using the capture technique and structure described above. More specifically, an edge of the end wall 54 is captured between the shoulder portion 60 and the edge portion 58 of the cylindrical wall 52.

Progressing from the edge of the end wall 54 toward the center of the end wall 54, the end wall 54 is machined to have the concentric raised rib 80. The end wall 54 is then turned inward towards the center of the vessel 50 and the inward turned area defines a hole for receiving the inlet/outlet fitting 70. Accordingly, the rib 80 is disposed generally in a circle around the inlet/outlet fitting 70 and as best seen in FIG. 5B forms a concentric structure around in the inlet/outlet fitting 70. However, as one skilled in the art will appreciate, the rib 80 need not form a perfect circle and may have other geometric shapes, such as an oval, a square or the like.

Figure 6:
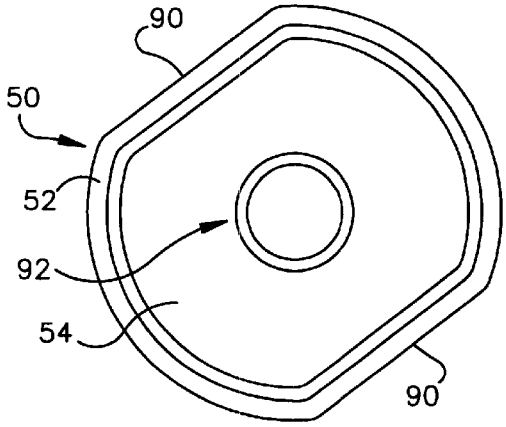
FIG. 6 is an end view of the vessel in an embodiment where the vessel has a cylindrical wall with generally flat side surfaces.

Referring now to FIG. 6, an end view of the vessel 50 in an embodiment where the cylindrical wall 52 has a least one generally flat side surface 90 is illustrated. The flat side surface 90 extends longitudinally along the cylindrical wall 52. As one skilled in the art will appreciate, the cylindrical wall 52 may be formed with the flat side surface 90 extending from a first end of the cylindrical wall 52 to a second end of the cylindrical wall 52, as illustrated. In an alternative implementation, only a portion of the cylindrical wall 52 has the generally flat side surface 90 as illustrated in FIG. 5A. In the illustrated embodiments, the vessel 50 has two generally flat side surfaces 90 disposed on opposite portions of the cylindrical wall 52.

The flat side surfaces 90 are used to assist in grasping the vessel 50 during installation into larger assembly, such as a refrigeration system 10. For example, the vessel 50 can be held from rotating by a tool or other member used to engage the flat side surfaces 90 as a component is threadably mated into threaded receptacle 92 defined by the end wall 54. In another arrangement, tooling may grasp the vessel 50 by the flat side surfaces 90 and position the vessel 50 as is desired and/or rotate the vessel 50 onto a threaded member. As one skilled in the art will appreciate, the flat side surfaces 90 provide a useful structure for assisting in the automated assembly of an apparatus which includes the vessel 50. The flat side surfaces 90 can also act as a datum, or an alignment indicator, to assist in positioning the vessel 50 with respect to a hole, tube, fitting or other part.

In one embodiment of the invention, the vessel 50 is made by starting with a cylindrical wall 52 having a circular cross-section taken along the longitudinal axis of the vessel 50. Then, the cylindrical wall 52 is rolled or otherwise machined to form the shoulder portion 60 in the cylindrical wall 52 as described above. Next, the generally flat side surfaces 90 are machined into the cylindrical wall 52 by, for example, pressing or stamping the sides of the cylindrical wall 52. Next the end wall 54 is inserted into the cylindrical wall 52 to rest on the shoulder portion 60. As one skilled in the art will appreciate, the end wall 54 is shaped to correspond to the shaped of the cylindrical wall 52 after the machining step to form the flat side surfaces 90. Next, the edge portion 58 is turned over the end wall 54 and the seam 64, if desired, is formed.

Figure 7:
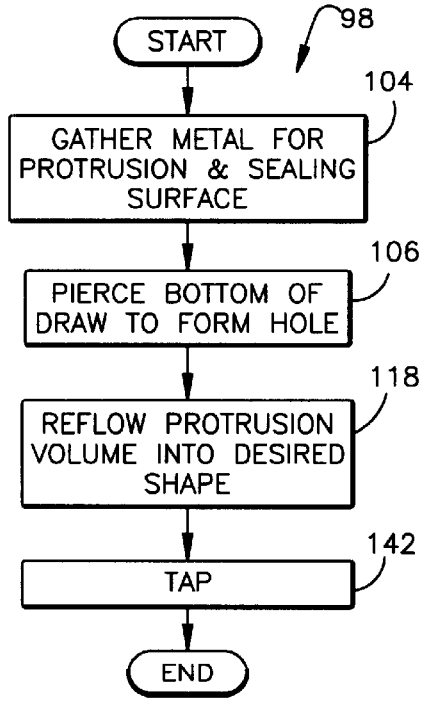
FIG. 7 is a flow chart illustrating a method of forming an end wall according to one embodiment of the invention.
Figure 8A:
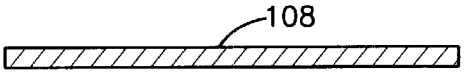
FIGS. 8A–8F illustrate the end wall formed by the method illustrated in FIG. 7 in various stages of manufacture.
Figure 8B:
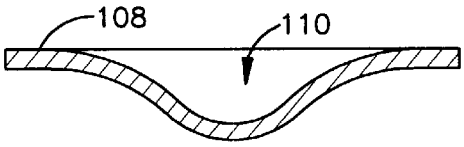
Figure 8C:
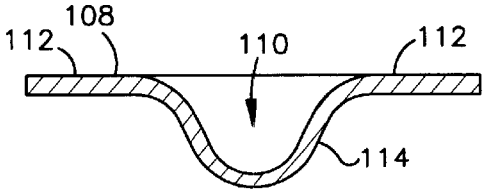

Referring now to FIG. 7, a method 98 of forming an end wall 54 (FIG. 8F) having a threaded receptacle 92, including a threaded opening 100 defined by an inward protrusion 106 and a sealing surface 102, for receiving a device such as a pressure relief valve 103 (FIG. 8G) or a refrigerant line. The method 98 begins in step 104 where metal is gathered for forming the protrusion 106 and the sealing surface 102 of the end wall 54. Step 104 begins by providing a blank 108 as illustrated in FIG. 8A. Next, the blank 108 is passed though a progressive die to form the end wall 54. In the first few stages of the progressive die, as illustrated in FIGS. 8B and 8C, one or more drawing punches (a punch having a radiused surface for engaging the work piece) are used to draw an indentation 110 into the blank 108. The indentation, as viewed in cross-section, has a "U-shape." Depending on the desired configuration of the end wall 54, the indentation may be formed with one drawing stage of the progressive die or in multiple stages of the progressive die, as illustrated. It has been found that in forming the end wall 54, about four draws are typical to form the desired indentation 110 illustrated in FIG. 8C. The portion of the blank 108 that remains substantially in the form of the initial blank 108 will be referred to as the parent metal 112 and the portion of the blank 108 which has been gathered and deformed by the drawing process will be referred to as an intermediate protrusion portion 114.

Figure 8D:
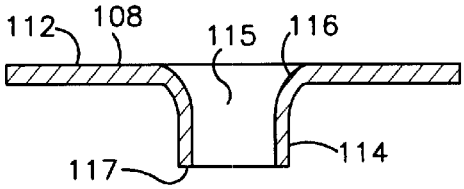

Next, in step 106, a die and punch combination is used to pierce the bottom the of the intermediate protrusion portion 114 to knock out a hole in the bottom of the intermediate protrusion portion 114, resulting in the tubular cross section for the intermediate protrusion portion 114 as illustrated in FIG. 8D. As shown, the inside wall 115 of the intermediate protrusion portion 114 forms a radiused intersection 116 with the parent metal 112. In addition, the thickness of the intermediate protrusion portion 114 tapers from wider to narrower as the intermediate protrusion portion 114 extends from the parent metal to a distal edge 117 of the intermediate protrusion portion 114.

It is noted that the dies and punches used to form the structure illustrated in FIG. 8D are selected to result in the intermediate protrusion portion 114 having a volume of metal sufficient for forming the sealing surface 102 and the protrusion portion 106 of the end wall 54 after a reflow step is carried out (i.e., step 118 of the method 98 discussed in more detail below). As one skilled in the art will appreciate, steps 104 and 106 of the method 98 comprise drawing processes where metal is gathered from the parent metal 112 of the blank 108 from an area surrounding the desired protrusion. This technique allows for the formation of a longer protrusion than is achieved with extrusion processes. However, the drawing technique thins the metal in the area where the protrusion meets the parent metal and creates the tapered shape of the inside and outside diameters of the protrusion as mentioned above. This effect is also known in the art as shock thinning. The thinned stock of the intermediate protrusion portion 114 is generally not sufficient to receive a threaded member, such as a threaded fitting of a pressure relief valve. In addition, the relatively large radius found at the radiused intersection 116 is not sufficient to seat a device against the blank 108 to form a generally leak-proof junction between the vessel 50 and the device without the use of gaskets, washers, brazing, welding, soldering or the like.

Figure 8E:
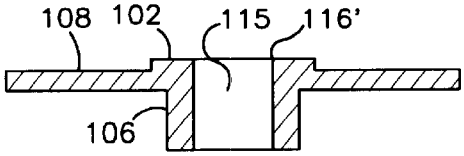

As indicated, the end wall 54 formed by the method 98 is used to receive a device, such as a pressure relief valve or refrigerant line. To minimize assembly steps and reduce the number of parts needed to form a generally leak proof junction between the vessel 50 and the device, a flat sealing surface having small corner radii is desired. In addition, a threaded opening disposed perpendicular or nearly perpendicular to the sealing surface is desired. Accordingly, the method 98 continues in step 118 where the blank 108 is reflowed to form the sealing surface 102 and the protrusion portion 106 illustrated in FIG. 8E.

Figure 9:
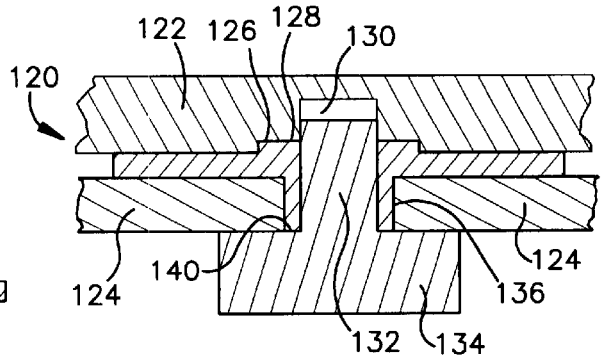
FIG. 9 illustrates a die and punch assembly used during the formation of the end wall, the end wall formed by the method illustrated in FIG. 7.

With additional reference to FIG. 9, the blank 108 is captured in a capture die 120. The capture die 120 has a first section, or first portion 122, and a second section, or second portion 124. The first portion 122 of the capture die 120 is placed against the side of the blank 108 to be formed with the sealing surface 102. The second portion 124 of the capture die 120 is placed against the side of the blank 108 to be formed with the protrusion portion 106.

The first portion 122 has a recess 126 for receiving reflowed metal as described below. The recess 126 has a stop surface 128 against which the reflowed metal will press against to form the sealing surface 102. The first portion 122 is formed with another recess 130 for receiving a pilot portion 132 of a punch 134. Alternatively, the recess 130 can be replaced by a passage extending all the way through the first portion 122. The punch 134 is used to reflow the metal of the blank 108. The recess 130 has an inside diameter which is the same or slightly larger than the desired inside diameter of the protrusion 106. Similarly, the pilot 132 has a outside diameter which is the same as the desired inside diameter of the protrusion portion 106. Accordingly, the inside diameter of the recess 130 is sized to allow for slip fit of the pilot 132.

The second portion 124 of the capture die 120 defines an opening 136 having an inside diameter that is the same as or slightly larger than the desired outside diameter of the protrusion portion 106.

After the blank 108 has been capture by the capture die 120 as illustrated in FIG. 9, the punch 134 is stamped against the distal edge 117 of the intermediate protrusion portion 114. The punch 134 has an engagement surface 140 which engages the distal edge 117 of the intermediate protrusion portion 114 and pushes the intermediate protrusion portion 114 into the capture die 120 where the metal of the blank 108 is reflowed. The pilot 132 maintains the desired inside diameter of the resulting protrusion portion 106. As a result of pressing or stamping the punch 134 against the blank 108 in this manner, metal is also reflowed into the recess 126 and against the stop surface 128 for form the desired sealing surface 102.

In an alternative embodiment, the recess 126 is omitted from the first portion 122 of the capture die 120 such that the stop surface 128 is formed flush with the parent metal 112. In yet another embodiment, the stop surface 128 is formed on a downwardly projecting annual portion of the first portion 122 of the capture die 120. In this embodiment, the sealing surface 102 will be disposed below the surface of the parent metal 112.

It is noted that after actuating the punch 134, the intersection of the sealing surface 102 and the protrusion 106, or radiused intersection 116', is radiused. However, the radiused intersection 116' has a much smaller radius as compared to the radiused intersection 116 present after step 106. It is also noted that the pressing depth of the punch 134 is controlled to avoid closed die coining (i.e., completely filling recess 126 with reflowed metal), which could lead to die damage and/or progressive die machine damage. In addition, closed die coining can cause splitting of the work piece. However, if splitting of the blank 108 occurs, the method 98 can be modified so that the blank 108 is partially reflowed using a first punch 134 actuation, then annealed and then reflowed to completion using a second punch 134 actuation.

It is further noted that the pilot 132 should have a length so that the pilot 132 can sufficiently enter the recess 130 before the engagement surface 140 begins to press the distal edge 117 of the intermediate protrusion portion 114. As a result, the pilot 132 can control metal flow into the first portion 122 of the capture die 120.

Figure 8F:
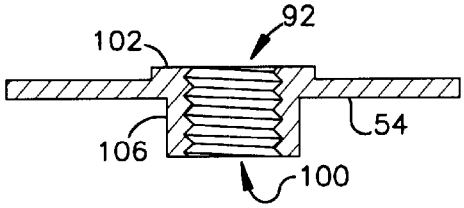
Figure 8G:
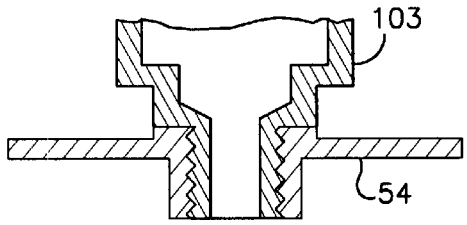
FIG. 8G illustrates the end wall formed by the method illustrated in FIG. 7 threadably engaging a device.

After the punch 134 has been used to reflow the metal, the punch 134 is extracted and the blank 108 is removed from the capture die 120. Next, in step 142, and as illustrated in FIG. 8F, the protrusion 106 is tapped to form the threaded opening 100. In one embodiment of the method 98, the threading is formed using a threaded form tap to minimize excessive reflowing of the metal and minimize the production of "chips." If desired, the parent metal 112 portion of the end wall 54 can be machined to have a bowed configuration as described above for the end wall 54 illustrated in FIGS. 2 through 4D.

As one skilled in the art will appreciate, the structure of the protrusion 106 and the sealing surface 102 as formed on the end wall 54 of the vessel 50 and being used to receive a device, such as a pressure relief valve or a refrigerant line, has application in other environments. Therefore, the method 98 can be used to in processing components for a variety of end uses.

Although particular embodiments of the invention have been described in detail, it is understood that the invention is not limited correspondingly in scope, but includes all changes, modifications and equivalents coming within the spirit and terms of the claims appended hereto.

What is claimed is:

1. A vessel for use in a refrigeration system, comprising:

a vessel body; and at least one end wall for closing the vessel body, the end wall having a threaded receptacle, wherein the threaded receptacle is configured to accept a threaded fitting and wherein the threaded receptacle includes:

an annular sealing surface for engaging a corresponding surface of the fitting, the sealing surface formed on a first side of the end wall; and a threaded surface defined by an inside wall of an annular protrusion, the annular protrusion having a longitudinal axis disposed generally perpendicular to the sealing surface, and wherein the protrusion extends longitudinally from a second side of the end wall toward an interior of the vessel body.

2. The vessel of claim 1, wherein the sealing surface is raised above a surface of the first side of the end wall.

3. The vessel of claim 1, wherein the sealing surface is planar.

4. The vessel of claim 1, wherein the sealing surface is planar and an intersection of the sealing surface and inside wall is radiussed.

5. In combination, the vessel of claim 1 and a pressure relief valve, the pressure relief value including the threaded fitting and wherein the vessel is configured to be pressurized and the fitting is engaged with the threaded receptacle.

6. In combination, the vessel of claim 1 and a refrigerant line, the refrigerant line including the threaded fitting and wherein the fitting is engaged with the threaded receptacle.

7. In combination, the vessel of claim 1 and the threaded fitting, the threaded fitting in engagement with the threaded receptacle such that the sealing surface and the corresponding surface form a metal to metal seal.

8. In combination, the vessel of claim 1 and the threaded fitting, the threaded fitting in engagement with the threaded receptacle, wherein the sealing surface engages with the corresponding surface without interposing a washer, a gasket or a seal.

9. In combination, the vessel of claim 1 and the threaded fitting, the threaded fitting in engagement with the threaded receptacle, wherein the sealing surface engages with the corresponding surface without the use of brazing, welding or soldering.

10. A method of making the end wall of claim 1, comprising the steps of:

drawing a metal blank with a drawing punch to form an intermediate protrusion and thereby gathering metal for the sealing surface and annular protrusion;

forming a hole in a bottom of the drawn intermediate protrusion;

capturing the metal blank in a capture die having a first portion with a stop surface against which the sealing surface is formed and a second portion defining an opening for controlling formation of an outside diameter of the annular protrusion; and reflowing the drawn intermediate protrusion with a punch, the punch having a pilot for controlling the formation of an inside diameter of the annular protrusion and an engagement surface for engaging a distal edge of the intermediate protrusion.

11. A method as set forth in claim 10, further comprising the step of tapping the annular protrusion.

* * * * *